US006919788B2

(12) United States Patent
Holdahl et al.

(10) Patent No.: US 6,919,788 B2
(45) Date of Patent: Jul. 19, 2005

(54) LOW PROFILE HIGH CURRENT MULTIPLE GAP INDUCTOR ASSEMBLY

(75) Inventors: Jimmy D. Holdahl, Watertown, SD (US); Todd Settergren, Watertown, SD (US); Chad W. Gortmaker, Florence, SD (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/743,843

(22) Filed: Dec. 22, 2003

(65) Prior Publication Data

US 2004/0135660 A1 Jul. 15, 2004

Related U.S. Application Data

(63) Continuation of application No. 10/109,409, filed on Mar. 27, 2002, now abandoned.

(51) Int. Cl.[7] ..... H01F 27/02

(52) U.S. Cl. ..... 336/83; 336/192; 336/221; 336/96; 336/233; 336/212

(58) Field of Search ..... 336/83, 96, 65, 336/180, 182, 183, 192, 212, 220, 221, 90, 198; 29/602.1

(56) References Cited

U.S. PATENT DOCUMENTS

| | | | | |
|---|---|---|---|---|
| 4,118,103 A | | 10/1978 | Leidy et al. | 339/98 |
| 4,160,966 A | | 7/1979 | Kennedy | 336/155 |
| 4,424,504 A | | 1/1984 | Mitsui et al. | 336/83 |
| 4,602,122 A | | 7/1986 | Lint | 174/52.1 |
| 4,696,100 A | | 9/1987 | Yamamoto et al. | 29/605 |
| 4,754,370 A | | 6/1988 | DeTizio et al. | 361/404 |
| 4,760,366 A | | 7/1988 | Mitsui | 336/233 |
| 4,777,461 A | | 10/1988 | Sakamoto | 333/184 |
| 4,962,361 A | | 10/1990 | Ida | 336/90 |
| 5,212,345 A | | 5/1993 | Gutierrez | 174/52.5 |
| 5,309,130 A | | 5/1994 | Lint | 336/65 |
| 5,347,255 A | | 9/1994 | Saitoh et al. | 336/83 |
| 5,351,167 A | | 9/1994 | Wai et al. | 361/760 |
| 5,760,669 A | | 6/1998 | Dangler et al. | 336/65 |
| 6,252,486 B1 | * | 6/2001 | Wolf | 336/200 |
| 6,285,272 B1 | * | 9/2001 | Boytor et al. | 336/83 |
| 6,392,519 B1 | * | 5/2002 | Ronning | 336/90 |
| 6,456,183 B1 | | 9/2002 | Basteres et al. | 336/200 |

FOREIGN PATENT DOCUMENTS

| | | | |
|---|---|---|---|
| DE | 951826 C | | 11/1956 |
| DE | 1046796 B | | 12/1958 |
| DE | 3615307 A | | 11/1987 |
| DE | 4432739 A | | 3/1996 |
| FR | 1 032 001 A1 | | 2/2000 |
| FR | 1032001 A1 | * | 2/2000 |
| GB | 2284102 | | 5/1995 |
| WO | WO 99/17318 A | | 4/1999 |

OTHER PUBLICATIONS

International Search Report for International Application No. PCT/US03/07493 dated Jun. 23, 2003.

Patent Abstracts of Japan, vol. 1998, No. 10, Aug. 31, 1998 & Japanese Publication No. JP 10–135044 A (Kawasaki Steel Corp.), May 22, 1998, (abstract only).

* cited by examiner

*Primary Examiner*—Lincoln Donovan
*Assistant Examiner*—Jennifer A. Poker

(57) ABSTRACT

An inductor assembly includes a coil or coils of insulated conductor material defining an inside volume, an inner core of magnetic core material located within the inside volume, and an outer core of magnetic core material including structure overlying the coil and inner core and having opposite inner walls facing polar ends of the coil and core, such that at least two magnetic gaps exist between ends of the inner core and the opposite inner walls of the outer core. A method for making the assembly is also disclosed.

24 Claims, 1 Drawing Sheet

LOW PROFILE HIGH CURRENT MULTIPLE GAP INDUCTOR ASSEMBLY

This is a continuation of U.S. patent application Ser. No. 10/109,409, filed on Mar. 27, 2002, now abandoned, the disclosure of which is incorporated herein by reference.

BACKGROUND OF THE INVENTION

1. Field of the Invention

The present invention relates to electrical inductors and transformers. More particularly, the present invention relates to a low profile, high current inductor or transformer including a ferromagnetic core structure having multiple gaps to reduce stray electromagnetic fields.

2. Introduction to the Invention

High current, low profile inductors and transformers are widely used in diverse applications in the fields of telecommunications, power conversion, and digital data circuits. Such electrical components most frequently employ ferromagnetic cores and shields. Ferromagnetic materials such as iron powder, and ferrimagnetic materials such as ferrites (also referred to hereinafter as "ferromagnetics"), have a characteristic temperature below and above which their electromagnetic properties differ greatly. This temperature is known as the Curie temperature. Above the Curie temperature, these materials behave as paramagnetic materials. Below the Curie temperature, these materials exhibit well-known hysteresis B versus H curves. When used as core structures for inductors and transformers, it is essential to keep these materials below the Curie temperature and also to prevent core saturation. One known way to inhibit core saturation of these materials is to provide a gap in a magnetic core structure.

As circuit layouts continue to become smaller and smaller, a hitherto unsolved need has arisen to minimize stray electromagnetic fields associated with inductors and transformers having conductors carrying high currents and carried in two-piece ferromagnetic cores having a gap to prevent core saturation. While magnetic core structures have often been used in high current environments and applications, prior approaches to reduce size and unwanted radiated emissions while carrying ever increasing levels of current have proven to result in structures that were either too bulky in size, too hot in operation, or just too hazardous to use in a particular application or environment.

In a typical electromagnetic device 11 of the prior art as shown in FIG. 1, a single discrete air gap 10 is defined in a two-piece ferromagnetic core structure 12. The gap 10 enables the core structure 12 to handle large amounts of electrical current without saturating. As noted above, once a magnetic core structure saturates, it ceases to operate with its desired inductive capabilities. In practical situations core saturation can result in anything from a simple overload condition to thermal runaway and even catastrophic failure. Although the air gap 10 can usually prevent the magnetic core from saturating, it has an adverse effect on any nearby conductors. A magnetic field (denoted by reference numeral 13) at the air gap 10 effectively reduces the current carrying capability of a conductor 14 because of the well known "proximity effect". The proximity effect is present when conductors are exposed to strong magnetic fields and exhibit larger than expected resistance to current flow. Increased conductor resistance results in generation of higher levels of heat and can lead directly to thermal runaway and catastrophic failure of the electromagnetic device and/or circuit or appliance including the device.

Examples of gapped core electrical inductors transformers of the prior art are provided by U.S. Pat. No. 4,424,504 to Mitsui et al., entitled: "Ferrite Core"; and U.S. Pat. No. 4,760,366 to Mitsui, entitled: "Ferrite Core".

BRIEF SUMMARY OF THE INVENTION

A general object of the present invention is to provide an inductor assembly having a two-piece, two gap, ferromagnetic core overcoming limitations and drawbacks of the prior art.

Another object of the present invention is to provide a method for manufacturing an inductor assembly including a two-piece, two gap, ferromagnetic core in a manner overcoming limitations and drawbacks of the prior art.

In accordance with principles of the present invention, an inductor assembly includes a coil or coils of insulated conductor material defining an inside volume, an inner core of magnetic core material located within the inside volume, and an outer core of magnetic core material including structure overlying the coil and inner core and having opposite inner walls facing polar ends of the coil and core, such that at least two magnetic gaps exist between ends of the inner core and the opposite inner walls of the outer core. Adhesive secures the inner core in position within the inside volume of the coil, and potting material encapsulates the inner core and coil relative to the outer core in order to maintain the two magnetic gaps. The magnetic core material of the inner core and the outer core is most preferably selected from a group including MnZn, NiZn, MPP (molybdenum permalloy powder), metal alloy powder cores sold under the trademark Kool Mu™ (approximately 85% iron, 6% aluminum, and 9% silicon), nickel-iron powders such as Hi-Flux (approximately 50% nickel-50% iron) and sendust (approximately 80% nickel-20% iron), amorphous alloys, iron, and iron powder. In order to achieve a low profile, the coil and the inner core are provided with a flattened shape, and the outer core has a flattened, rectangular box shape.

As one aspect of the present invention, terminal ends of the coil of insulated conductor material have outwardly exposed flat contact surfaces to facilitate surface mounting of the inductor assembly to a printed circuit board or circuit substrate. To prevent unwanted oxidation of the contact surfaces prior to surface mounting, the exposed flat contact surfaces are preferably tinned or coated with a lead-free antioxidant material.

As another aspect of the present invention, at least one end of the inner core is provided with a recess defined to control inductive characteristic rouoff of the assembly as the inner core approaches core saturation in a use environment The present invention also provides a method for constructing an inductor assembly comprising steps of:

forming a coil of insulated conductor material to define an inside volume, forming an inner core from magnetic core material having a size and geometry adapted to be located within the inside volume, securing the inner core within the inside volume with an adhesive to form a subassembly, forming an outer core of magnetic core material to provide a structure overlying the coil and inner core and opposite inner walls facing polar ends of the coil and core, and locating and securing the subassembly in the outer core between the opposite inner walls such that at least two magnetic gaps exist between ends of the inner core and the opposite inner walls of the outer core.

This aspect of the present invention preferably includes a further step of preparing terminal ends of the coil for direct surface mount connection to a printed circuit board or circuit substrate.

These and other objects, advantages, aspects and features of the present invention will be more fully understood and appreciated upon consideration of the detailed description of preferred embodiments presented in conjunction with the following drawings.

BRIEF DESCRIPTION OF THE DRAWINGS

The invention is illustrated by the drawings in which.

DETAILED DESCRIPTION OF THE INVENTION

The present invention provides a new method for handling large air gaps. Namely, by providing and using multiple air gaps along the magnetic path, the magnetic field that exists in the air gap is easily reduced by a factor of four. This reduction in the magnetic field will decrease the proximity effect resulting in decreased effective resistance of the wire comprising the inductor or transformer winding. Current flowing through conductors manifesting reduced effective electrical resistance results in the generation of less heat and a smaller radiated electromagnetic field. Since the radiated field is smaller, so are resultant radiated emissions, especially in the preferred embodiment shown in FIG. 2. Utilizing this new technique, a smaller inductor/transformer structure can be realized for a given amount of energy storage, with lower effective resistance, less heat generation, and lower radiated emissions.

Figure 1:
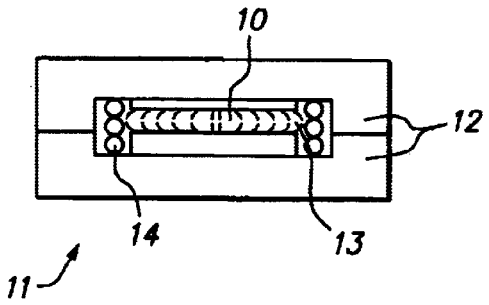
FIG. 1 (PRIOR ART)
FIG. 1 is an enlarged sectional view of an inductor having a two-piece ferromagnetic core structure and a single gap in accordance with the prior art.
Figure 2:
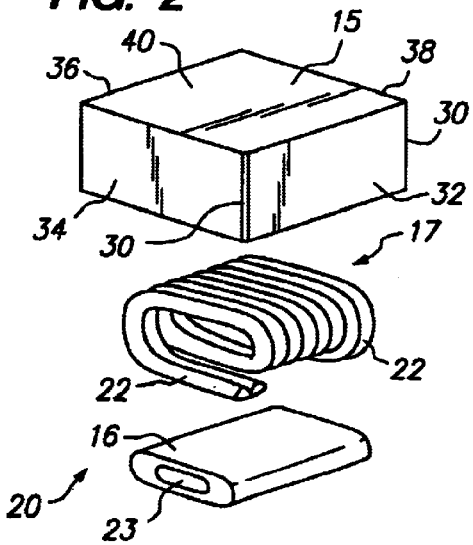
FIG. 2 is an enlarged isometric assembly view of a low profile, high current inductor or transformer including a ferromagnetic core structure having multiple gaps to reduce stray electromagnetic fields in accordance with principles of the present invention.
Figure 3:
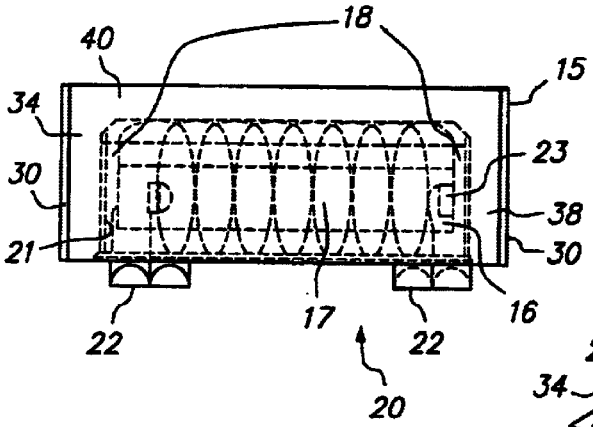
FIG. 3 is an enlarged x-ray view in elevation of a completed assembly of the FIG. 2 components.
Figure 4:
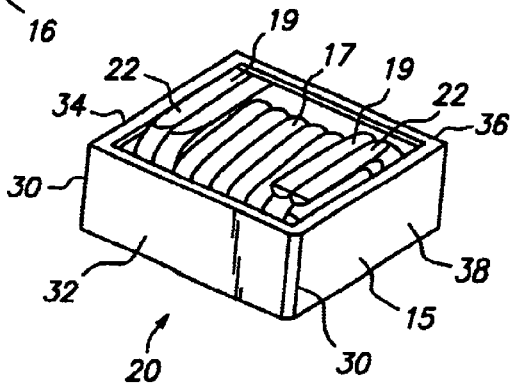
FIG. 4 is an enlarged isometric bottom view of the FIG. 3 completed assembly, showing flats formed on conductors to facilitate automated pick and place surface mounting and bonding of the assembly to a circuit board.

As shown in FIG. 2, and FIG. 3 and FIG. 4, an inductor/transformer assembly 20 includes a three element structure comprising an outer box-like structure 15 overlying an inner structure 16 and a conductor structure 17 and having, e.g., outer corner edge chamfers 30, sidewall portions 32, 34, 36, 38, and a top wall portion 40 (hereinafter referred to as "the outer core") and an inner rod-like structure 16 (hereinafter referred to as "the inner core"). The outer core 15 and the inner core 16 are both primarily composed of a suitable ferromagnetic material such as but not limited to MnZn, NiZn, MPP, or iron powder. The outer core 15 and the inner core 16 may be formed by any known process including but not limited to compression molding or sintering of powdered core material. The other element of assembly 20 is a conductor structure 17 comprising at least one-half turn around the inner core 16.

The inner core 16 can be reduced in length along a longitudinal axis relative to an inside dimension between facing inner walls 21 of the outer core 15 to leave a desired gap length 18 as required to prevent the core from saturating. This dimensioning of the length of the inner core 16 is typically accomplished through the use of conventional surface grinding, cutting, or other abrading techniques suitable for the magnetic material being used in the inner core 16. This process is often referred to as "gapping" the core.

Additionally, the inner core 16 may be provided with a recess 23 at one or both ends thereof. A primary function of the recess 23 is to adjust the saturation characteristic of a particular inductor assembly by control of relative shape of the recess. If the recess 23 were not provided, the inductive characteristics would roll off at a much faster rate as the inner core 16 approaches saturation. However, by providing the recess 23, a more gentle rolloff will begin sooner as the inner core 16 approaches saturation. By controlling the size and geometry of the recess 23, a desired rolloff characteristic can be provided for a particular inductor/transformer assembly.

Once the inner core 16 is gapped to the desired length, a coil of an insulated conductor can either be wound directly on the inner core or a pre-wound coil 17, shown in FIG. 2, can be inserted over the inner core 16. In the FIG. 2 example two interleaved coils are preformed on a mandrel or other fixture, and the resultant inductor assembly 20 comprises e.g., a bifilar-wound transformer. In accordance with principles of the present invention, the inner core 16 is centered upon the wound coil 17 along a common longitudinal axis as shown in FIG. 3. When so centered, two magnetic gaps 18 are defined at each end of the inner core 16. Preferably, the inner core 16 is placed into the preformed coil 17 with a positive stop being provided by a manufacturing fixture that extends partially into the interior space defined by the coil 17. The depth of the manufacturing fixture establishes the length of each gap 18. The inner core 16 is then secured to the coil 17 by a quick setting adhesive, or is held in place mechanically by compressive spring effect and friction of the coil 17 against the inner core 16. The entire assembly 20 is later completed by positioning a subassembly of the coil 17 and the inner core 16 into a cavity defined by the outer core 15 and injecting or pouring a dielectric potting material (typically an epoxy or silicone-based material) into the cavity to secure the coil-inner core subassembly in a desired position relative to the outer core 15 thereby defining the two magnetic core gaps 18 as shown in FIG. 3.

If the first and last turns of the coil 17 are wound as shown in FIG. 2 to extend slightly radially outwardly of the interior turns of the coil 17, an expedient lead-free, surface mount connection treatment 19 can be realized utilizing well known abrading, cutting, lapping, and/or grinding techniques to remove the dielectric coating from the wire ends 22, as shown in FIG. 4. The bare exposed conductor of wire ends 22 can then be tinned or coated with a non-lead-containing antioxidant material to prevent oxidation, keeping it ready for surface mount soldering into an electrical device or circuit board at a later date.

Obvious modifications of this invention include but are not limited to the conductor size, number of turns of the conductor, wire type, magnetic material of either the inner or outer core, and the use of a base to accommodate different printed circuit board (PCB) footprints, for example. Also, while FIG. 2 illustrated s single-layer coil 17 of relatively large diameter wire, a multi-layer coil of smaller diameter wire could readily be used. Further, while the surface-mount preparation of conductor ends as shown in FIG. 4 may be employed with larger diameter conductor wires, other means can be employed to attach the inductor/transformer assembly to a printed circuit board, including providing a dielectric plastic base with metal terminals to which smaller diameter wires of the coil will be welded, crimped, or soldered to the terminals. Also, the approach disclosed in the commonly assigned, copending patent application, application Ser. No. 10/109,162, filed Mar. 27, 2002, and entitled: "Self-Leaded Surface Mount Component Holder" may be used to facilitate surface mounting of an inductor/transformer of the present invention. The disclosure of that application is hereby incorporated in its entirety herein by reference.

Having thus described preferred embodiments of the invention, it will now be appreciated that the objects of the invention have been fully achieved, and it will be understood by those skilled in the art that many changes in construction and widely differing embodiments and applications of the invention will suggest themselves without departing from the spirit and scope of the invention. Therefore, the disclosures and descriptions herein are purely illustrative and are not intended to be in any sense limiting.

What is claimed is:

1. An inductor assembly comprising:

at least one coil of insulated conductor material defining an inside volume, an inner core of magnetic core material located within the inside volume, and an outer core of magnetic core material including topwall and sidewall structure overlying the coil and inner core and having opposite inner wall portion facing polar ends of the coil and inner core such that at least two magnetic gaps exist between ends of the inner core and the opposite inner wall portion of the outer core.

2. The inductor assembly of claim 1 wherein the coil and the inner core have a flattened shape.

3. The inductor assembly of claim 1 wherein the outer core has a rectangular box shape.

4. The inductor assembly of claim 1 comprising a low-profile inductor wherein the outer core has a rectangular box shape and the coil and inner core have a flattened shape.

5. The inductor assembly of claim 1 wherein terminal ends of the coil of insulated conductor material have outwardly exposed flat contact surfaces to facilitate surface mounting of the inductor assembly to a printed circuit board or circuit substrate.

6. The inductor assembly of claim 5 wherein the exposed flat contact surfaces are coated with an antioxidant material not containing lead.

7. The inductor assembly of claim 1 wherein at least one end of the inner core has a recess defined to control inductive characteristic rolloff of the assembly as the inner core approaches core saturation.

8. The inductor assembly of claim 1 wherein the magnetic core material of the inner core and the outer core is selected from a group including MnZn, NiZn, MPP, Ni—Fe, Fe—Al—Si, amorphous alloys, iron, and iron powder.

9. The inductor assembly of claim 1 further comprising potting material for encapsulating the inner core and coil in position relative to the outer core to maintain the at least two magnetic gaps.

10. The inductor assembly of claim 1 further comprising adhesive for securing the inner core in position within the inside volume of the coil, and potting material for encapsulating the inner core and coil in position relative to the outer core to maintain the at least two magnetic gaps.

11. The inductor assembly of claim 1 comprising multiple coils thereby forming a transformer.

12. A method for constructing an inductor assembly comprising steps of:

forming at least one coil of insulated conductor material to define an inside volume, forming an inner core from magnetic core material having a size and geometry adapted to be located within the inside volume, securing the inner core in place within the inside volume to form a subassembly, forming an outer core of magnetic core material having a continuous topwall and sidewall to provide a structure overlying the coil and inner core and opposite inner wall portions facing polar ends of the coil and inner core, and locating and securing the subassembly in the outer core between the opposite inner walls such that at least two magnetic gaps exist between ends of the inner core and the opposite inner walls of the outer core.

13. The method for constructing an inductor assembly set forth in claim 12 wherein the steps of securing the inner core in place within the inside volume and locating and securing the subassembly in the outer core result in said at least two magnetic gaps being of substantially equal length as determined along a longitudinal axis of the inner core and coil subassembly.

14. The method for constructing an inductor assembly set forth in claim 12 comprising a further step of preparing terminal ends of the coil for direct surface mount connection to a printed circuit board or circuit substrate.

15. The method for constructing an inductor assembly set forth in claim 14 wherein the step of preparing terminal ends comprises a step of defining flat faces having surfaces lying substantially within a single plane.

16. The method for constructing an inductor assembly set forth in claim 15 wherein the step of preparing terminal ends further includes a step of applying a lead-free antioxidant material to the flat faces.

17. The method for constructing an inductor assembly set forth in claim 15 wherein the step of preparing terminal ends further includes a step of tinning.

18. The method for constructing an inductor assembly set forth in claim 12 wherein the step of forming the inner core includes the step of defining a recess in an end of the inner core to control inductive characteristic rolloff of the assembly as the inner core approaches core saturation in use within an intended circuit environment.

19. The method for constructing an inductor assembly set forth in claim 12 wherein the steps of forming the inner core and forming the outer core are carried out by using magnetic core material selected from a group including MnZn, NiZn, MPP, Ni—Fe, Fe—Al—Si, amorphous alloys, iron, and iron powder.

20. The method for constructing an inductor assembly set forth in claim 12 wherein the step for forming the at least one coil comprises the step of forming plural coils so that the inductor assembly comprises a transformer.

21. A low profile high current multiple gap inductor assembly comprising:

at least one insulated electrical conductor sized to carry a relatively high current formed into a helical coil having a generally flattened shape and formed by at least one turn around an inside open volume defined by the coil, an inner core of magnetic core material having a generally flattened shape sized to fit within the open volume of the coil, a low profile box-shaped outer core of magnetic core material including continuous topwall and sidewall portions and having opposite inner wall segments facing polar ends of the coil and inner core such that at least two magnetic gaps exist between ends of the inner core and inner wall segments of the outer core, potting material encapsulating the inner core and coil within an interior volume of the outer core to maintain the two magnetic gaps, and electrical contact regions defined at opposite ends of the electrical conductor for enabling surface mounting and electrical connection of the inductor assembly to conductive traces of a printed circuit board.

22. The low profile high current multiple gap inductor assembly set forth in claim 21 wherein the inner core is held in position within the inside open volume of the coil by an adhesive material.

23. The low profile high current multiple gap inductor assembly set forth in claim 21 wherein the generally flattened shapes of the coil and inner core are generally oval shaped.

24. The method for constructing an inductor assembly set forth in claim 12 wherein the step of forming at least one coil of insulated conductor material to define an inside volume comprises forming a flattened helical coil having at least one turn and wherein the step of forming an inner core from magnetic core material having a size and geometry adapted to be located within the inside volume comprises forming a flattened inner core.

* * * * *